US010626568B2

(12) United States Patent
McCormick

(10) Patent No.: US 10,626,568 B2
(45) Date of Patent: Apr. 21, 2020

(54) WASTE COLLECTOR

(71) Applicant: Joseph McCormick, Homer Glen, IL (US)

(72) Inventor: Joseph McCormick, Homer Glen, IL (US)

( * ) Notice: Subject to any disclaimer, the term of this patent is extended or adjusted under 35 U.S.C. 154(b) by 57 days.

(21) Appl. No.: 16/034,247

(22) Filed: Jul. 12, 2018

(65) Prior Publication Data

US 2020/0018027 A1 Jan. 16, 2020

(51) Int. Cl.
*A47L 13/52* (2006.01)
*E01H 1/12* (2006.01)

(52) U.S. Cl.
CPC ..... *E01H 1/1206* (2013.01); *A47L 13/52* (2013.01)

(58) Field of Classification Search
CPC ..... A47L 13/52; E01H 1/04
See application file for complete search history.

(56) References Cited

U.S. PATENT DOCUMENTS 5,343,589 A * 9/1994 Davenport ..... A47L 13/52 15/257.4
6,023,812 A * 2/2000 Morad ..... A47L 13/52 15/257.1
6,282,745 B1 * 9/2001 Alt ..... A47L 13/52 15/257.4
7,509,705 B1 * 3/2009 Morad ..... A47L 13/52 15/257.1
10,201,262 B1 * 2/2019 Serfas ..... A47L 13/51
2005/0071943 A1 * 4/2005 Liu ..... A47L 13/52 15/257.2
2008/0092321 A1 * 4/2008 Lin ..... A47L 13/52 15/257.7
2018/0116481 A1 * 5/2018 Henao ..... A46B 17/06

* cited by examiner

*Primary Examiner* — Michael D Jennings
(74) *Attorney, Agent, or Firm* — The Law Offices of Konrad Sherinian

(57) ABSTRACT

A waste collector comprises a handle assembly, a receptacle, a lid pivotally attached to the receptacle, a yoke operatively coupled to a shaft of the handle assembly, and a set of locking members. The yoke is pivotally attached to the receptacle. The lid incorporates a guiding channel for receiving the shaft. The receptacle incorporates a downward lip. A subset of the locking members is attached to walls of the receptacle and another subset of the locking members is attached to the yoke. Each locking member incorporates a set of through cuts. The set of through cuts creates a corresponding set of leaves. Each leave within the set is flexible and adapted to extend away from the corresponding locking member when a force is applied. When the force is released, the leaf intends to retain its original form.

14 Claims, 3 Drawing Sheets

100
101
102
112
104
116
202
106
204
136
124
126
134
132
138

100
101
102
104
112
108
116
212
202
402
106
404

WASTE COLLECTOR

CROSS REFERENCE TO RELATED APPLICATIONS

This application is related to U.S. patent application Ser. No. 15/365,310, entitled "IMPROVED LOBBY PAN," filed Nov. 30, 2016.

FIELD OF THE DISCLOSURE

The present disclosure generally relates to waste collecting devices. More particularly, the present disclosure relates to a lobby pan (or dust pan) having a waste container attachment mechanism to allow for convenient and clean removal of collected waste from the lobby pan.

BACKGROUND

Lobby pans, which are also known as dust pans, are well known in the prior art. In particular, lobby pans are used as a temporary receptacle for small amounts of waste, such as dust, candy wrappers, discarded food, etc., as well as refuse, such as vomit, animal feces, etc. Lobby pans are used in individual dwellings, but their use is especially widespread in commercial settings, such as office buildings, hospitals, food industry sites such as kitchens and restaurants, schools, etc.

Generally, a lobby pan will comprise a receptacle that is pivotally mounted to a shaft using any of the well-known pivotal mounting means in the art. The shaft can be connected to a handle including, for example, an aperture by which the lobby pan can be hung. When downward pressure is applied to the handle, the receptacle portion will pivot downward to allow waste and refuse to be swept into it. When upward pressure is applied to the handle, the receptacle portion will swing upwards, thereby preventing waste and refuse from falling out. In the upward position, the receptacle portion can be locked in place using a mechanism known in the art, such as a slot and hook. Alternatively, in the upward position, the lobby pan can be unlocked.

However, after the waste collected into the receptacle is emptied, the receptacle can still contain some amount of the waste that is stuck to the interior surface of the receptacle. For instance, when the waste is dog feces, the small amount of the waste attached to the inside surface of the receptacle would produce undesirable smell, sanitation hazard, and an unwanted scene. It is inconvenient to thoroughly clean the receptacle each time the waste collector is used. Accordingly, there is a need for a new type of waste collectors that allows convenient and complete removal of collected waste therein.

Objects of the Disclosed Lobby Pan

Accordingly, it is an object of this disclosure to provide a waste collector that does not make direct contact with the collected waste.

Another object of the disclosure is to provide a waste collector that does not require cleaning after use.

Another object of the disclosure is to provide a waste collector that is odorless after use.

Another object of the disclosure is to provide a waste collector with a set of locking members for keeping a waste container open and in position.

Another object of the disclosure is to provide a waste collector with a set of locking members allowing convenient removal of a waste container disposed in the waste collector.

Another object of the disclosure is to provide a lobby pan that does not make direct contact with the collected waste.

Another object of the disclosure is to provide a lobby pan that does not require cleaning after use.

Another object of the disclosure is to provide a lobby pan that is odorless after use.

Another object of the disclosure is to provide a lobby pan with a set of locking members for keeping a waste container open and in position.

Another object of the disclosure is to provide a lobby pan with a set of locking members allowing convenient removal of a waste container disposed in the waste collector.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

Generally speaking, pursuant to the various embodiments, the present disclosure provides an improved waste collector. The improved waste collector includes a receptacle having two side walls, a front wall, a rear wall and a bottom wall. The two side walls each incorporate an aperture. The improved waste collector also includes a yoke pivotally mounted to the side walls and extending therebetween. In addition, the improved waste collector includes a substantially straight elongated shaft having a bottom end and a top end. The bottom end is secured to the yoke at a position approximately midway between the side walls. Moreover, the improved waste collector includes a first locking member and a second locking member attached to the two side walls respectively and covering the apertures respectively. The first locking member and the second locking member each incorporate a set of through cuts, thereby forming a set of leaves. Each leaf within the set of leaves is flexible and intends to retain an original form when a force applied to the leaf is released. The improved waste collector further includes a third locking member attached to the yoke and covering an aperture on the yoke. The third locking member incorporates a third set of through cuts, thereby forming a third set of leaves. Each leaf within the third set of leaves is flexible and intends to retain an original form when a force applied to the leaf is released. The first, second and third locking members each are adapted to lock a piece of a waste container in position. The improved waste collector also includes a lid pivotally mounted to the receptacle. The lid incorporates a guiding channel for receiving the shaft. The rear wall incorporates a front lip. The improved waste collector further includes a handle associated with the shaft.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION

Figure 1:
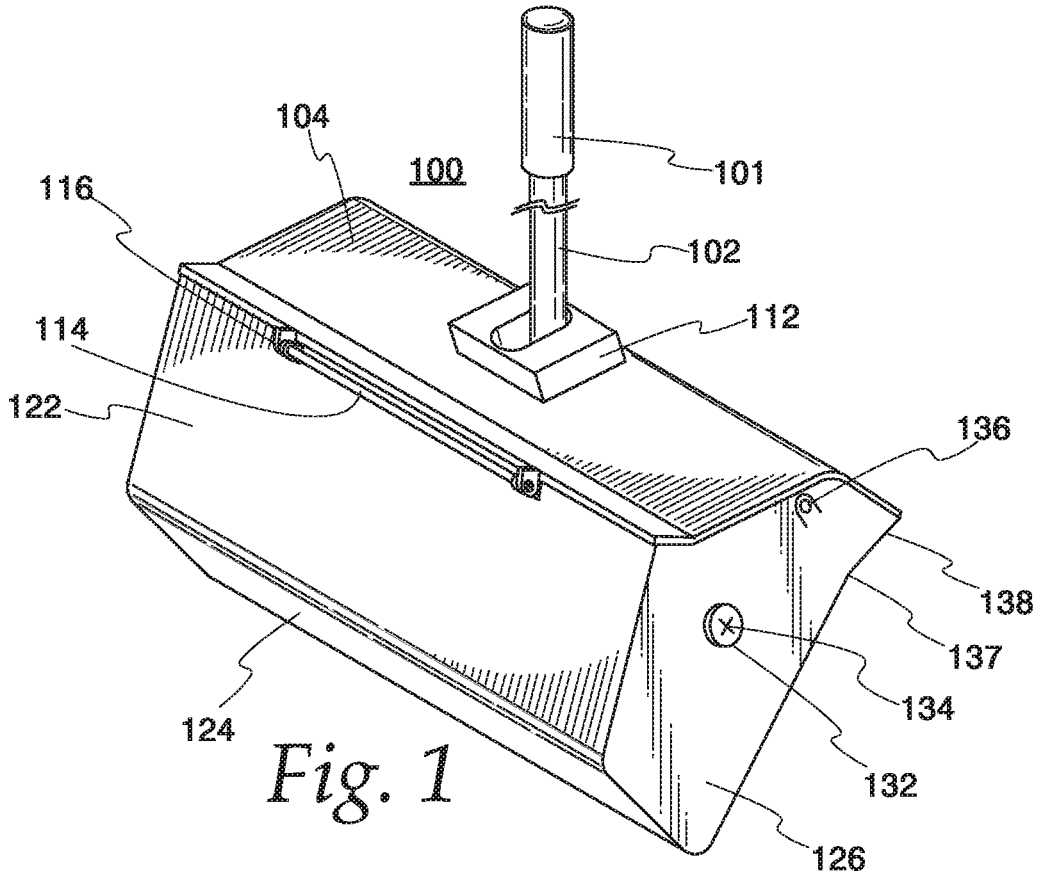
FIG. 1 is a front perspective view of an improved waste collector in a carrying position in accordance with the present disclosure.
Figure 2:
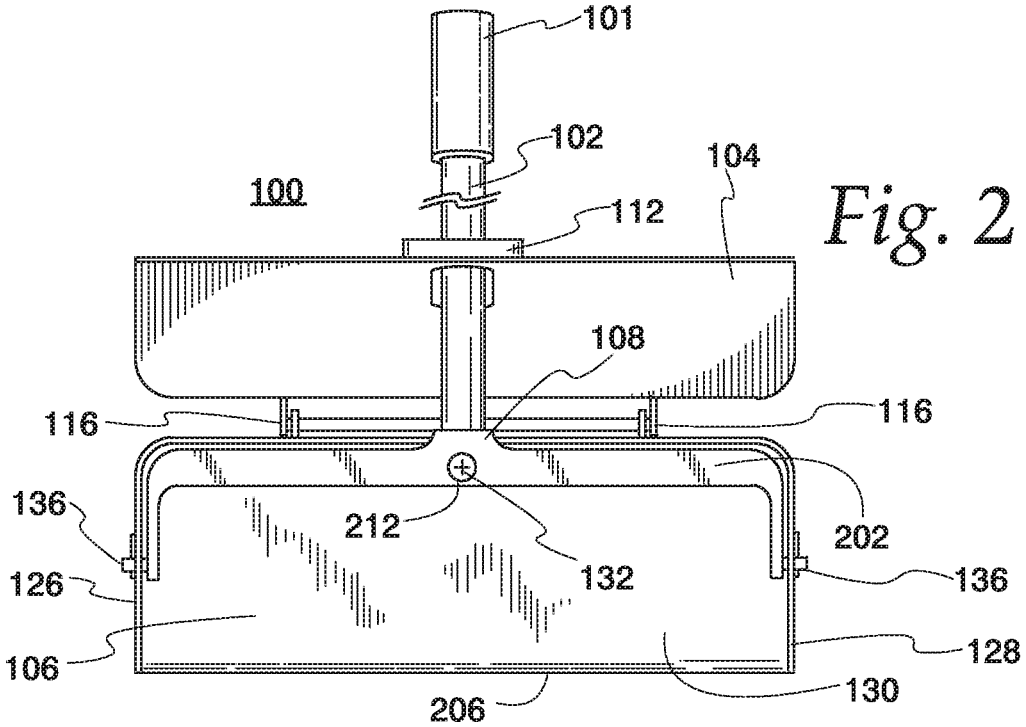
FIG. 2 is a rear perspective view of an improved waste collector in a deployed position in accordance with the present disclosure.
Figure 3:
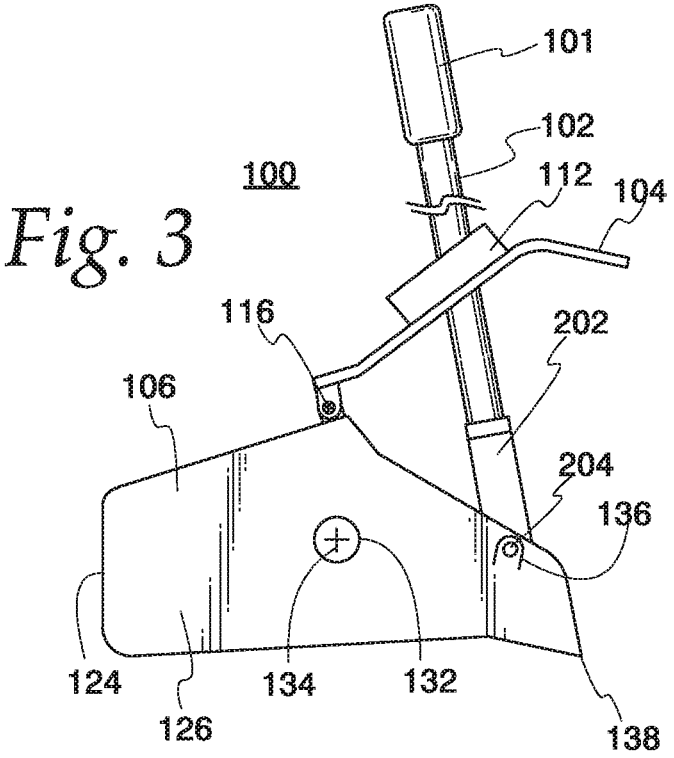
FIG. 3 is a right side view of an improved waste collector in a deployed position in accordance with the present disclosure.

Turning to the figures, and to FIGS. 1, 2 and 3 in particular, an improved waste collector is illustrated and generally indicated 100. The lobby pan 100 is shown in a carrying position in FIG. 1 and in a deployed position in FIGS. 2 and 3. The improved waste collector 100 includes a handle 101, a shaft 102, a lid 104, a receptacle portion 106, a yoke 108, and three locking members 132.

The handle 101 and the shaft 102 operatively coupled to the handle 101 are collectively referred to herein as a handle assembly. The receptacle portion 106 is pivotally connected to the yoke 108. The yoke 108 is connected to one end of a shaft 102, and thus said to be operatively coupled to the shaft 102. The other end of the shaft 102 is connected to a handle 101. The receptacle portion 106 of the lobby pan 100 includes a rear wall 122, a bottom wall 124, a pair of parallel separated side walls 126, and a rear wall 130. The open ends of side walls 126 generally have a diagonal edge portion 137 forming a lip 138 at one end thereof.

The lid 104 is pivotally mounted to the receptacle 106 via a pin 114 and a pair of axially aligned connectors 116 provided in the front wall 122 of the receptacle 106. Alternatively, the lid 104 is pivotally connected to the receptacle 106 via the pair of axially aligned connectors 116 and two corresponding pins. In addition, the lid 104 provides a guiding channel 112 through which the shaft 102 moves relative to the lid 104.

As depicted, the receptacle 106 is mounted to shaft 102 by a rotary or pivotal hinged mechanism that includes a pair of axially aligned connectors 136 provided in the side walls 126 of the receptacle 106. A pair of mounting pins 204 are mounted in in the side walls 126 and are operatively coupled to the yoke 108.

Figure 5:
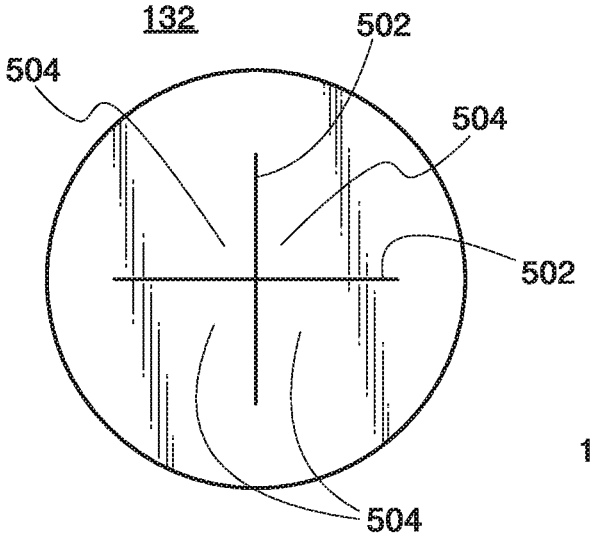
FIG. 5 is a top view of a locking member of an improved waste collector in accordance with the present disclosure.
Figure 8:
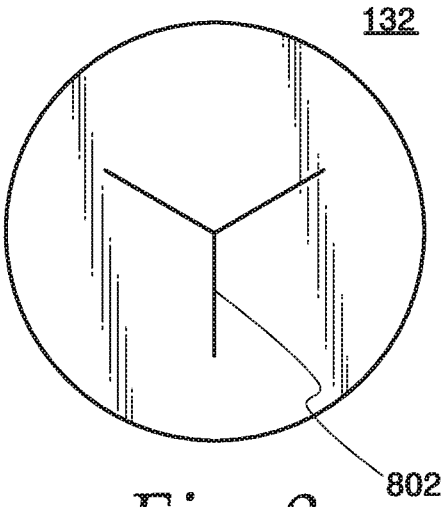
FIG. 8 is a top view of a locking member of an improved waste collector in accordance with the present disclosure.

The two side walls 126 and the yoke 108 each incorporate an aperture. Each of the aperture is covered by a locking member 132. The locking members 132 are attached to the side walls 126 and the yoke 108 respectively. The attachment can be achieved using, for example, glue, screws or other attachment techniques. In one implementation, each locking member 132 includes two crossing through cuts. As shown in FIG. 5, the two crossing through cuts create four leaves 504. The two crossing through cuts 502 can be replaced with different through cuts, such as the through cuts 802 shown in FIG. 8, without deviating from the present teachings.

Each locking member 132 is made of flexible materials (such as rubber). Accordingly, when applied with force, the leaves 504 can be push away from the flat surface of the locking member 132. In addition, when the force against the leaves 504 is removed, the leaves 504 intend to regain their original form.

Figure 6:
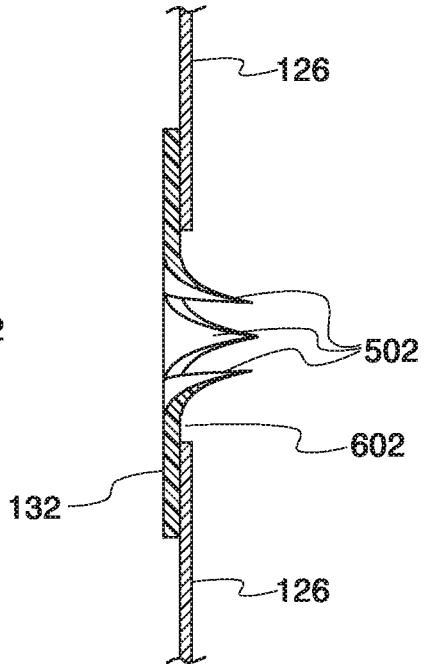
FIG. 6 is a side view of a locking member attached to a side wall of an improved waste collector in a pushed position in accordance with the present disclosure.

Referring now to FIG. 6, a locking member 132 is attached to a side wall 126, and covers an aperture 602 on the side wall 126. When the leaves 504 are push by, for example, a finger of a user of the waste collector 100, they extend away from the flat surface of the locking member 132 and the side wall 126. In such a case, they extend into the aperture 602.

Turning back to FIG. 2, when the receptacle 106 is placed on a flat surface to be cleaned, it will assume a horizontal position. The handle 101 and associated shaft 102 are in a substantially upright position, but tilts towards the bottom wall 124. In order to assume the position illustrated in FIG. 1, downward pressure is applied to the handle 101 to transform the lobby pan 100 from the carrying position (as shown in FIG. 1 hereafter) to the active position shown in FIGS. 2 and 3. The pressure is transmitted through the shaft 102 and the yoke 108 to push the lip 138 downward to the surface to be cleaned.

The pivoting of the shaft 102 and the yoke 108 pushes the shaft 102 against the guiding channel 112, and thus causes the lid 104 to pivot about the axis of the connectors 116. The pivoting of the lid 104 opens the receptacle 106. When the user has collected the waste into the receptacle, the user simply lifts the handle 101 upward. Accordingly, via the shaft 102 and yoke 108, the receptacle 106 lifted up with the lip 138 moving upward before the bottom wall 124 is lifted upward. The lid 104 then makes contact with the lip 138 and closes the receptacle. Lifting the handle 101 permits the receptacle 106 to assume a vertical or inactive position as illustrated in FIG. 1. The yoke 108 incorporates a frame 202 and an aperture 212 in the frame 202. The aperture 212 is covered by the locking member 132

Figure 4:
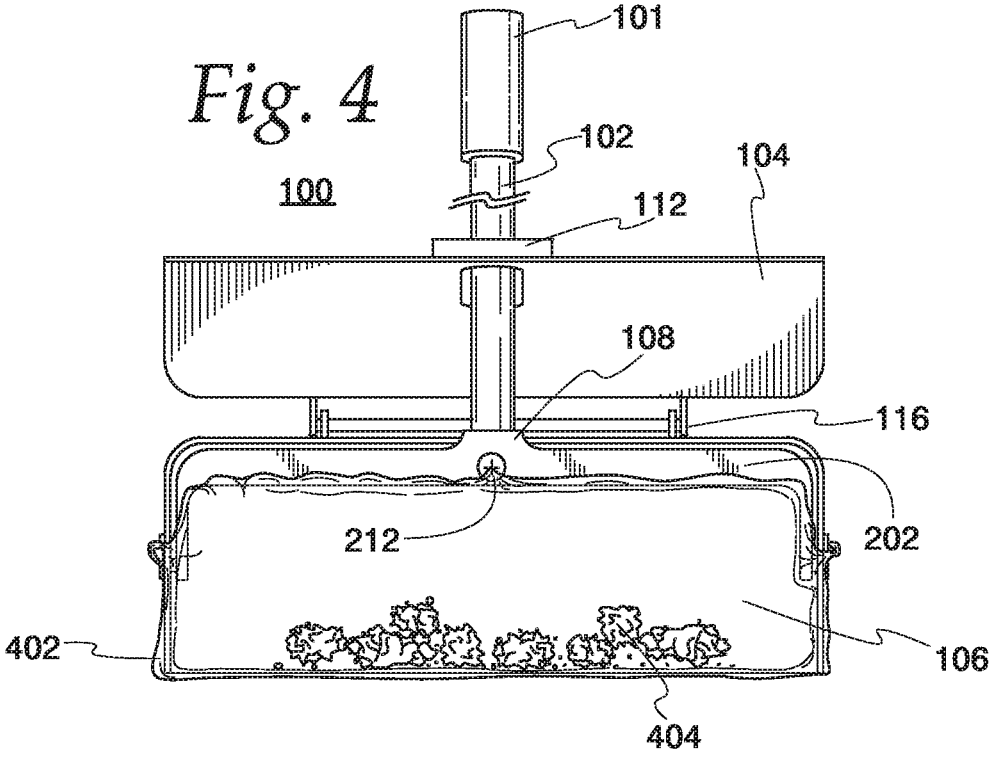
FIG. 4 is a rear perspective view of an improved waste collector in a deployed position with some collected waste in accordance with the present disclosure.
Figure 7:
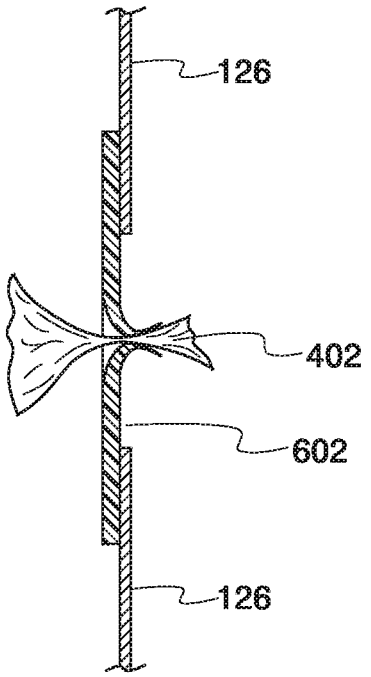
FIG. 7 is a side view of a locking member mounted to an improved waste collector with a waste container locked therein in accordance with the present disclosure.

Referring to FIG. 4, a perspective view of the waste collector 100 in a deployed position is shown. When in the deployed position, the lid 104 leaves the receptacle 106 open to allow a user to install a waste container 402, such as a plastic bag. To install the waste container 402, the user uses one or two fingers to push a piece of the waste container 402 against and through each of the locking members 132. The user then retracts her/his fingers and leaves the piece of the waste container 402 behind. The flexible leaves 504 then return to their original form and position. The piece of the waste container 402 is then jammed between the leaves 504 and locked between the same. The locked piece of the waste container 402 is further illustrated by reference to FIG. 7. Since the leaves 504 are made of flexible materials, they can be pushed or pull away from the locking member 132 in both directions.

In one operation, the user uses a plastic bag (similar to a plastic grocery shopping bag) to collect her dog's feces on her lawn. To do so, she first places the improved waste collector 100 into the deployed position as shown in FIG. 2 before she places the body of the plastic bag 402 into the receptacle. She then inserts the two handles of the plastic into the two locking members 132 on the side walls 126. The leaves 504 of the two locking members 132 lock the two handles in position. She further flips one open edge of the plastic bag such that it wraps over the edge 206 of the rear wall 130 to ensure that waste does not move into the receptacle between the rear wall 130 and the container 402. Thereafter, she grabs the middle part of the other open edge of the plastic bag 402 that is closer to yoke 108 and inserts it into the locking member 132 of the yoke 108. Once it's locked by the locking member 132, she collects waste 404 into the plastic bag 402. When the collection is finished, she lifts the handle 101 to cause the waste collector to assume the closed position as shown in FIG. 1.

At the closed position, she pulls the two handles of the plastic bag 402 away from the locking members 132 on the side walls 126. She then grabs the two handles and pull them away from the waste collector 100. In such a case, the piece of the plastic bag 402 that is locked into the locking member 132 on the yoke 108 is pulled out. The plastic bag 402 containing the entirety of the collected waste 404 is thus easily and cleanly removed from the waste collector 100. The waste 404 does not make direct contact with the interior surface of the waste collector 100 itself, and is conveniently collected and disposed. Accordingly, the improved waste collector 100 is odorless and not required to be cleaned after the cleaning of the waste 404.

It should be noted that the locking members 132 keep the waster container 402 in position during use of the waster collector 100. The waster container 402, such as a thin plastic bag, is usually light. The leaves 504, in their natural position, hold the container 402 tightly. In contrast, hooks on the receptacle 100 would not be able to hold the container 402 tight or in position.

Obviously, many additional modifications and variations of the present disclosure are possible in light of the above teachings. Thus, it is to be understood that, within the scope of the appended claims, the disclosure may be practiced otherwise than is specifically described above. For example, the bottom wall 124 takes a curved surface, not flat as shown in FIG. 1. As an additional example, the side walls 126 is neither flat nor parallel.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. An improved waste collector comprising:

a) a receptacle including two side walls, a front wall, a rear wall and a bottom wall;

b) a yoke pivotally mounted to said side walls and extending therebetween;

c) a substantially straight elongated shaft having a bottom end and a top end, said bottom end being secured to said yoke at a position approximately midway between said side walls; and d) a first locking member and a second locking member attached to and extending from outer surfaces of said two side walls respectively, said first locking member and said second locking member each incorporating a set of through cuts, thereby forming a set of leaves, each leaf within said set of leaves being flexible and intending to retain an original form when a force applied to said leaf is released, said first and second locking members each adapted to lock a piece of a waste container in position wherein said waste container is a not part of said improved waste collector.

2. The improved waste collector of claim 1 further comprising a third locking member attached to said yoke, said third locking member incorporating a third set of through cuts, thereby forming a third set of leaves, each leaf within said third set of leaves being flexible and intending to retain an original form when a force applied to said leaf is released.

3. The improved waste collector of claim 2 wherein said third locking member is adapted to lock a piece of a waste container in position wherein said waste container is not a part of said improved waste collector.

4. The improved waste collector of claim 3 further comprising a lid pivotally mounted to said receptacle, wherein said lid incorporating a guiding channel for receiving said shaft.

5. The improved waste collector of claim 4 further comprising a handle associated with said shaft wherein said rear wall incorporates a front lip.

6. The improved waste collector of claim 3 wherein said rear wall incorporates a front lip.

7. The improved waste collector of claim 6 further comprising a handle associated with said shaft.

8. The improved waste collector of claim 1 wherein said two side walls each incorporates an aperture covered by said first locking member and said second locking member respectively.

9. The improved waste collector of claim 8 wherein said yoke incorporates an aperture covered by said third locking member.

10. The improved waste collector of claim 9 wherein said third locking member is adapted to lock a piece of a waste container in position, a body portion of said waste container adapted to be disposed inside said receptacle.

11. The improved waste collector of claim 10 wherein said rear wall incorporates a front lip.

12. The improved waste collector of claim 11 further comprising a handle associated with said shaft.

13. The improved waste collector of claim 1 further comprising a lid pivotally mounted to said receptacle, wherein said lid incorporating a guiding channel for receiving said shaft.

14. The improved waste collector of claim 13 further comprising a handle associated with said shaft wherein said rear wall incorporates a front lip.

* * * * *